US006271487B1

(12) United States Patent
Domzalski et al.

(10) Patent No.: US 6,271,487 B1
(45) Date of Patent: Aug. 7, 2001

(54) NORMALLY OPEN EXTENDED TRAVEL DUAL TACT SWITCH ASSEMBLY WITH SEQUENTIAL ACTUATION OF INDIVIDUAL SWITCHES

(75) Inventors: Frank M. Domzalski, Wellesley; William J. Agnatovech, Hudson, both of MA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/532,115

(22) Filed: Mar. 21, 2000

(51) Int. Cl.[7] ..... H01H 9/00; H01H 13/56; H01H 1/00

(52) U.S. Cl. ..... 200/1 B; 200/5 A; 200/18; 200/406; 200/516; 200/517

(58) Field of Search ..... 200/1 R, 1 B, 200/1 V, 5 R, 5 A, 18, 512–517, 406; 29/622

(56) References Cited

U.S. PATENT DOCUMENTS

| | | | | |
|---|---|---|---|---|
| 4,778,952 | * | 10/1988 | Watkins et al. | 200/5 A |
| 4,827,243 | | 5/1989 | Cheng | 341/22 |
| 5,172,114 | | 12/1992 | Bedoya et al. | 341/27 |
| 5,172,990 | | 12/1992 | Weng | 400/490 |
| 5,199,557 | | 4/1993 | Brandt et al. | 200/406 |
| 5,228,561 | | 7/1993 | Schroeder et al. | 200/517 |
| 5,345,051 | | 9/1994 | Miike | 200/345 |
| 5,380,969 | | 1/1995 | Yang | 200/517 |
| 5,389,755 | | 2/1995 | Chen | 200/341 |
| 5,399,824 | | 3/1995 | Chen | 200/534 |
| 5,510,584 | * | 4/1996 | Norris | 200/5 A |
| 5,726,400 | * | 3/1998 | Masuda | 200/16 D |
| 5,834,714 | * | 11/1998 | Berger et al. | 200/5 A |
| 5,898,147 | | 4/1999 | Domzalski et al. | 200/1 B |

* cited by examiner

*Primary Examiner*—J. R. Scott
(74) *Attorney, Agent, or Firm*—Pearson & Pearson, LLP

(57) ABSTRACT

A dual tactile feedback, three-state, low profile pushbutton switch comprising an insulated housing, a metal dome, an extended travel molded elastomeric dome or stem having a conductive material on a bottom surface for contacting the metal dome and contacts in the switch housing, a collar having an opening for a top portion of said elastomeric dome to protrude therethrough, and a fixed contact under the metal dome on the base of the insulated housing connected to a switch terminal. A flat plate with four legs is placed above the stem which moves adjacent to the walls of the housing. The plate extends through a frame and openings on the sides of the frame snap on to the sides of the insulated housing. Greater switch reliability is achieved by having the elastomeric dome with a bottom portion comprising a conductive material for contacting the metal dome. An alternate embodiment of the three-state switch comprises a pushbutton disposed above an upper, extruded, elastomeric element for lower cost advantages having conductive material on a bottom surface for making electrical contact within the base of the switch housing and a lower metal dome, when the pushbutton is activated. The lower metal dome also makes electrical contact with contacts in the base of the switch housing.

20 Claims, 11 Drawing Sheets

FIG. 3A
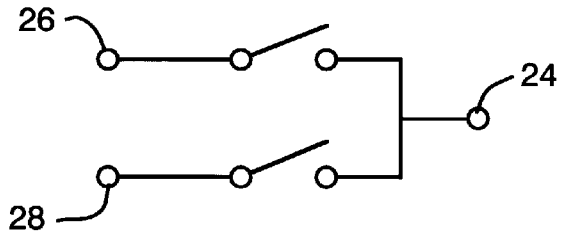
FIG. 3B
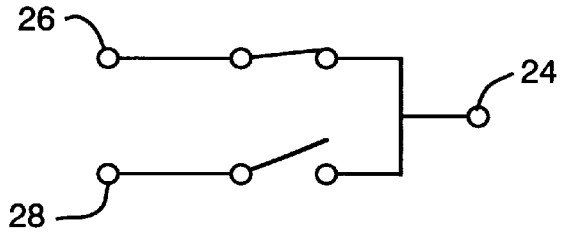
FIG. 3C
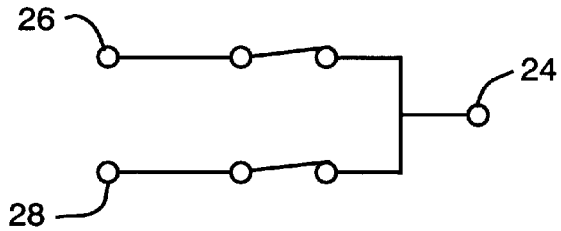
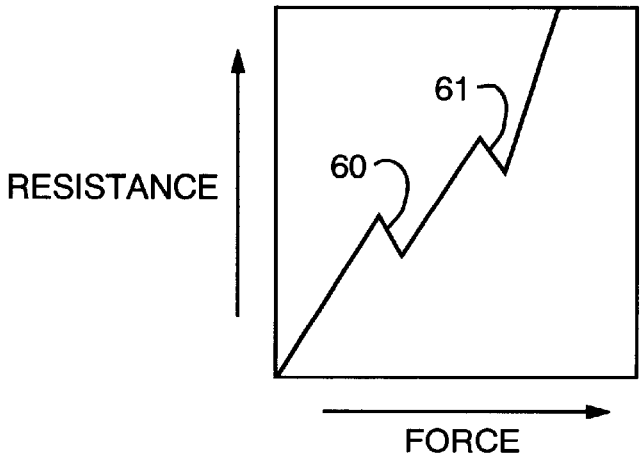
FIG. 6

NORMALLY OPEN EXTENDED TRAVEL DUAL TACT SWITCH ASSEMBLY WITH SEQUENTIAL ACTUATION OF INDIVIDUAL SWITCHES

BACKGROUND OF THE INVENTION

1. Field of the Invention

This disclosure relates generally to electrical switches and in particular to a more reliable, extended travel, dome-type pushbutton switch having tactile feedback and three states of switching.

2. Description of Related Art

Tactile feedback, push button switches are well known in the art, but for certain applications the life of the switch is not as long as may be desired or necessary. Often in dome switches, the top dome gets very stressed and the switch looses its tactile feel or fails. Also, the limited movement of the activating pushbutton in three-state switches minimizes the feel of the center position.

In U.S. Pat. No. 5,172,114 issued Dec. 15, 1992 to Claude Bedoya and assigned to Sextant Avionique of France, a tactile effect switch used in a keyboard is disclosed. The tactile effect is obtained by combining a snap acting switch and the deformation of an elastomer stud, axially deformable under compression, which is integrally formed on a membrane made from a resilient material disposed on a support plate and which provides a resilient connection between a key and the switch in the manner of a pusher. A resilient blade is deformed when pressure is applied to the stud causing actuation of the switch as the blade makes contact between an inner contact and two outer contacts.

In U.S. Pat. No. 5,228,561 issued Jul. 20, 1993 to Christopher K. Schroeder et al. and assigned to Hewlett-Packard Company of Palo Alto, Calif., a long traveling pushbutton switch with enhanced user tactile feedback is disclosed. The switch comprises a keycap, a keycap plunger, a retaining bezel, an elastomeric dome switch button formed in an elastomeric sheet comprising rubber which rests on a printed circuit board having a conductive pattern. Deformation of the button switch provides tactile feedback, while impact of the keycap top against the retaining bezel provides audible feedback. The pushbutton switch is configured to limit the downward displacement of the keycap plunger to avoid excessive force on the printed circuit board.

In U.S. Pat. No. 5,199,557 issued Apr. 6, 1993 to Gert Brandt et al. and assigned to MEC A/S of Ballerup, Denmark, a key is disclosed comprising a domed metal disc with its dome facing upward, a rubber component arranged on top of the domed metal disc which comprises a membrane part and a stem part. The stem part is a hollow part, which is elastically deformable and serves the purpose of transmitting a mechanical force from a button to which the mechanical force is applied to the domed metal disc, as the metal disc is deformed or allowed to revert to its normally domed shape from its deformed shape by the elastic deformation of the stem. The key has only two states whereby the metal dome makes contact with a central contact pad when the mechanical force is applied to the button (state 1) and brakes contact when the force is removed (state 2).

In U.S. Pat. No. 5,345,051, issued Sep. 6, 1994 to Teruhisa Miike and assigned to Alps Electric Company, Ltd., of Tokyo, Japan, a pushbutton switch is disclosed which has a comparatively small height and minimal rattling of a stem upon movement. The pushbutton switch comprises an insulating case, a pair of fixed contacts on the inner bottom of the case, a moveable contact for movement toward and away from the fixed contacts a stem for operating the movable contact and being resiliently biased away from the fixed contacts, the stem having a flat plate and four legs, a click rubber element positioned below the flat plate of the stem, and guide holes formed at the four corners of the insulating case. Thus when the flat plate of the stem is depressed, the top of the click rubber element is pushed down to resiliently deform the click rubber element until the movable contact contacts the fixed contact on the inner bottom face of insulating case to short-circuit the fixed contacts. When the stem is released, the click rubber element pushes up the stem by its own resilient returning force. This switch has only two states.

In U.S. Pat. No. 5,898,147, issued Apr. 27, 1999 to Frank M. Domzalski et al., and assigned to C & K Components, Inc., of Watertown, Mass., a dual action 3 state, convex disc pushbutton switch assembly is described which provided tactile feedback to the operator. Each convex disc contact comprises four tabs, each tab of which is fitted and secured in the base of the switch assembly making the switch easy to assemble and operate reliably. The tabs of a first convex disc contact are positioned forty-five degrees relative to the tabs of a second convex disc contact. The switch is sealed thereby permitting various ways to secure the switch terminals to an electronic board. However, the top disc experiences considerable stress during its operational usage and can loose its tactile feel or fail.

SUMMARY OF THE INVENTION

Accordingly, it is therefore an object of this invention to provide a three-state, tactile feedback pushbutton switch having an upper elastomeric dome with a conductive coated bottom surface contacting a lower metal dome for increased switch reliability.

It is a further object of this invention to provide a three-state, tactile feedback, pushbutton switch having extended travel for improved feel of an intermediate switch state.

It is another object of this invention to provide a semicircular conductor positioned below the elastomeric dome for making electrical contact with the metal dome.

It is another object of this invention to provide a circular conductor positioned below the elastomeric dome having opposite inwardly extending radial tabs for making electrical contact with the lower metal dome.

It is a further object of this invention to provide an alternate embodiment of the three-state tactile feedback, pushbutton switch comprising an extruded elastomeric switch element with a conductive bottom surface for improved reliability and lower cost.

These and other objects are accomplished by a tactile feedback pushbutton switch comprising an insulated housing having an inner bottom surface and a plurality of walls, a conductive contact provided on approximately the center of the inner bottom surface of the housing, an elastomeric dome disposed in the insulated housing having a conductive means attached to a bottom surface of the dome for making an electrical contact when the pushbutton is activated, a switching element, disposed between the conductive contact and the conductive means of said elastomeric dome, having a first state of no electrical contact, having a second state of making electrical contact with the conductive means of the elastomeric dome, and having a third state of the conductive means electrically contacting the switching element which contacts the conductive contact, as a pushbutton is being pressed in a direction toward the bottom surface of the housing, the pushbutton, disposed above the rubber dome, comprises a plurality of legs, for limiting the travel of the pushbutton within the housing, a collar disposed around the elastomeric dome having an opening for a top portion of the dome to extend therethrough, and a frame having an opening for the pushbutton to extend therethrough, the frame comprises at least a pair of sides which snap over tabs on the outside of the housing. The switch comprises at least three external terminals for connecting the switch in a circuit. The conductive means on the bottom of the elastomeric dome comprises a conductive coating. Alternate embodiments of the conductive means include a semicircular conductor, or the conductive means may include a circular conductor with two opposite inwardly extending tabs. The switching element comprises a metal dome.

The objects are further accomplished by a method of providing an extended travel tactile feedback pushbutton switch comprising the steps of providing an insulated housing having an inner bottom surface and a plurality of walls, providing a conductive contact on approximately the center of the inner bottom surface of the housing, disposing an elastomeric dome in the insulated housing having a conductive means attached to a bottom surface of the dome for making an electrical contact when a pushbutton is activated, disposing a switching element between the conductive contact and the elastomeric dome conductive means which provides a first switch state of no contact, pressing the pushbutton a first distance in a direction toward the bottom surface of the housing wherein the conductive means of the elastomeric dome makes electrical contact with the switching element which provides a second switch state, pressing the pushbutton a second distance in the direction of the bottom surface of the housing wherein the conductive means of the elastomeric dome electrically contacts the switching element which contacts the conductive contact, thereby providing a third switch state, providing the pushbutton having a plurality of legs disposed above the elastomeric dome, disposing a collar around the elastomeric dome, the collar having an opening for a top portion of the dome to extend therethrough, and extending the pushbutton through an opening in a frame, the frame having a pair of sides, each side having an opening which snaps over a tab on the outside of the housing. The method comprises the step of providing a plurality of external terminals extending from the housing for connecting the switch in a circuit. The step of providing the conductive means on the bottom of the elastomeric dome comprises the step of providing a silver silicone conductive coating on the bottom. The step of providing the conductive means on the bottom of the elastomeric dome comprises the step of providing a semicircular conductor positioned below the elastomeric dome. The step of providing the conductive means on the bottom of the elastomeric dome comprises the step of providing a circular conductor with two opposite inwardly extending tabs on the bottom positioned below the elastomeric dome. The step of providing the switching element comprises the step of providing a metal dome including silver plated stainless steel.

The objects are further accomplished by a tactile pushbutton switch comprising an insulated housing having an inner bottom surface and a plurality of walls, a pair of opposite walls of the housing, each of the walls having a pair of integral right angle appendages extending inward and disposed a predetermined distance from each other, a first conductive contact disposed on approximately the center of the inner bottom surface of the housing, a first switch element having an upper elastomeric portion and a lower portion comprising conductive means for making an electrical contact when the pushbutton is activated, second conductive contacts on the bottom surface of the housing, each disposed between the right angle appendages for making electrical contact with the lower portion of the first switch element on two opposite sides of the switch, a second switch element, disposed between the first conductive contact on the inner bottom surface of the housing and the conductive means of the first switch element, having a first state of no contact with the first switch element, having a second state of making electrical contact with the conductive means of the first switch element, and having a third state of the conductive means of the first switch element electrically contacting the second switch element which electrically contacts the first conductive contact, as a pushbutton of the switch is being pressed in a direction toward the bottom surface of the housing, the pushbutton, disposed above the elastomeric element, comprises a plurality of legs for limiting the travel of the pushbutton within the housing, retainer means, inserted between each of the right angle appendages on the opposite sides of the switch resting on top of the outer feet of the first switch element, for forcing the lower portion of the first switch element to make electrical contact with the second conductive contacts, and a frame having an opening for the pushbutton to extend therethrough, the frame having a pair of sides which secure the frame to the housing. The switch comprises a plurality of external terminals for connecting the switch in a circuit. The conductive means on the bottom of the elastomeric dome comprises a conductive coating including conductive silicone having a silver fill. The second switch element comprises a metal dome.

Additional objects, features and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

FIGS. 3A, 3B and 3C are electrical schematics of the three states of the switch of FIG. 1;

FIG. 6 is a compression curve (resistance force versus travel) of a pushbutton according to the invention;

DESCRIPTION OF ILLUSTRATIVE EMBODIMENT

Figure 1:
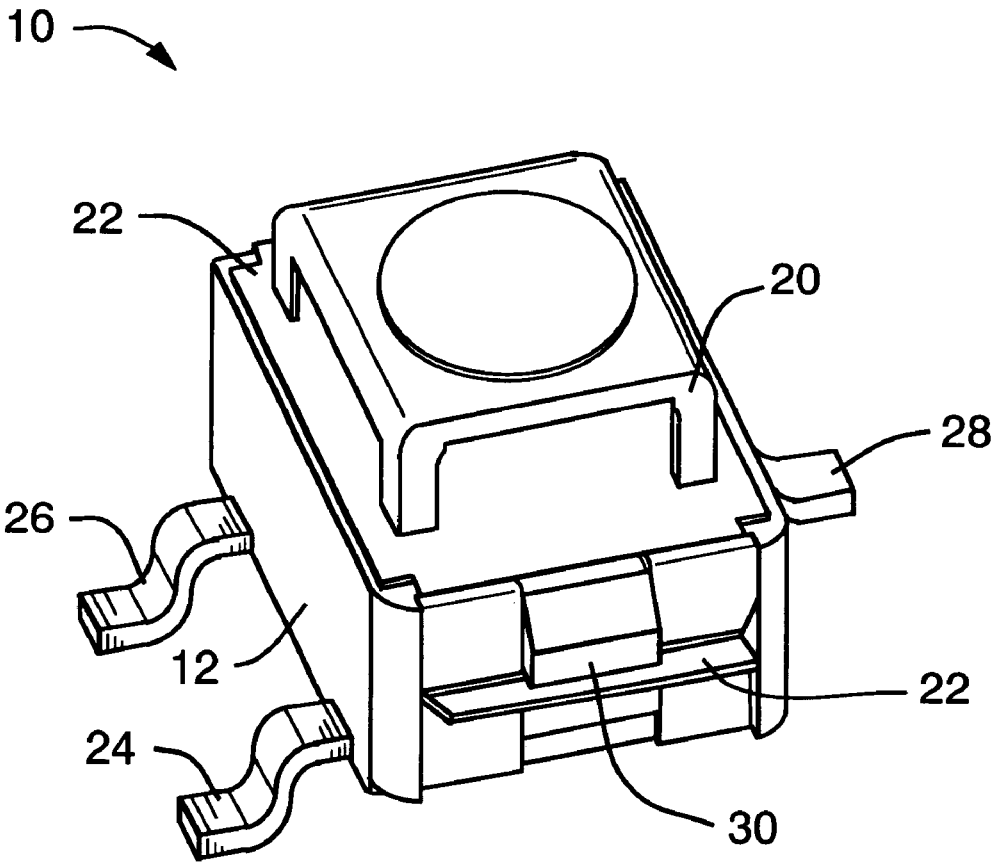
FIG. 1 is a perspective view of a preferred embodiment of a tactile feedback, three-state pushbutton switch.
Figure 2:
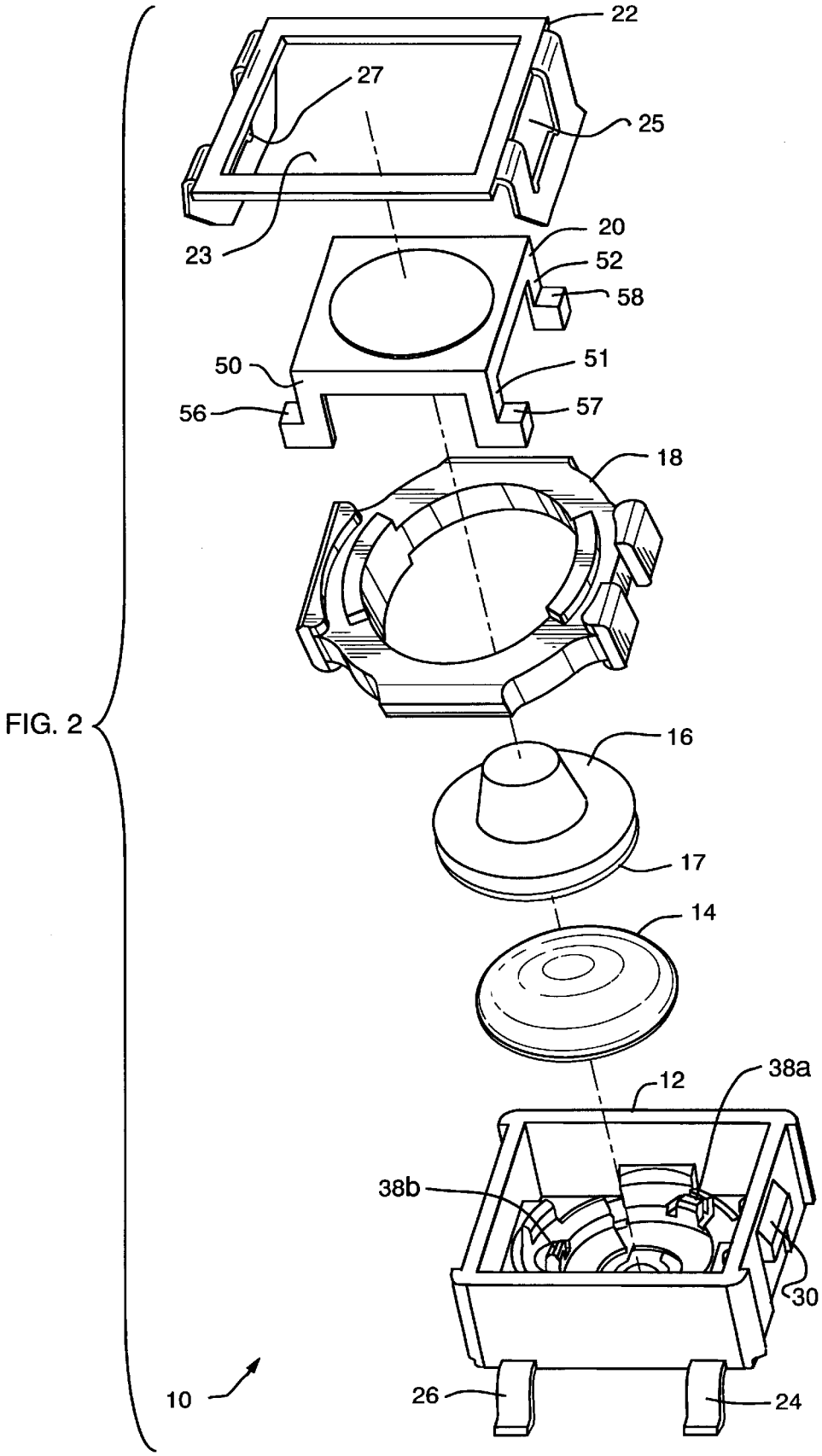
FIG. 2 is a fragmentary perspective view of the preferred embodiment tactile feedback, three-state pushbutton switch of FIG. 1.

Referring to FIG. 1 and FIG. 2, FIG. 1 is a perspective view of the preferred embodiment of the invention of a tactile feedback, three-state, pushbutton switch 10. FIG. 2 is an exploded perspective view of the switch 10 of FIG. 1 showing the individual components of the switch 10 that are enclosed in the housing 12.

The pushbutton switch 10 comprises a base housing 12 having two terminals 24, 26 extending from one side and a third terminal 28 extending from an opposite side of the housing 12.

A stem 20 extends above the housing 12 and acts as a pushbutton which is pushed to activate the switch 10. The stem 20 comprises four legs 50–53 and is secured within the housing 12 by a surface plate or frame 22 having an opening 23 on top for the stem 20 to protrude through. The frame 22 is secured to the housing 12 by tabs 30, 31 on opposite sides of the housing 12. Each of the tabs 30, 31 protrudes into openings 25, 27 on two sides of the frame 22 for holding the stem 20 within the switch housing 12.

Referring now to FIGS. 3A, 3B and 3C, electrical schematics of the three-state pushbutton switch 10 are shown. FIG. 3A shows the switch contacts in the normally open position. FIG. 3B shows the contacts in a first closed position whereby an electrical signal on terminal 24 is transferred to terminal 26. FIG. 3C shows the contacts in a second closed position whereby the electrical signal on terminal 24 is transferred to both terminals 26 and 28.

Referring again to FIG. 2, the pushbutton switch 10 is designed to have improved reliability over the prior art by providing tactile feedback with a metal dome 14 positioned under an upper elastomeric dome 16 having a conductive bottom surface facing the lower metal dome 14. The metal dome 14 is retained by the heat-stake posts 38*a*, 38*b* and 38*c* in the base portion of housing 12. A spacer 18 is positioned in the housing 12 around the upper portion of the elastomeric dome 16. The spacer 18, which does not move, provides force for contact between the upper dome 16 and terminal 36 in the base of housing 44. The spacer 18 essentially applies a pressure to the upper dome 16 to insure that electrical connection is made from metal dome 14 up to the conductive portion 17 of the elastomeric dome 16, and the elastomeric dome outer portion which makes contact with terminal 36 inside the housing 12.

The stem 20 comprises four legs 50–53 having outwardly protruding feet portions 56–59 provided at the ends of the legs 50–53 respectively as shown in FIG. 2. The legs 50–53 move along the four inside corners of the housing 12 and by the outside corners of spacer 18 as the pushbutton 20 moves in and out of the switch 10.

Figure 4:
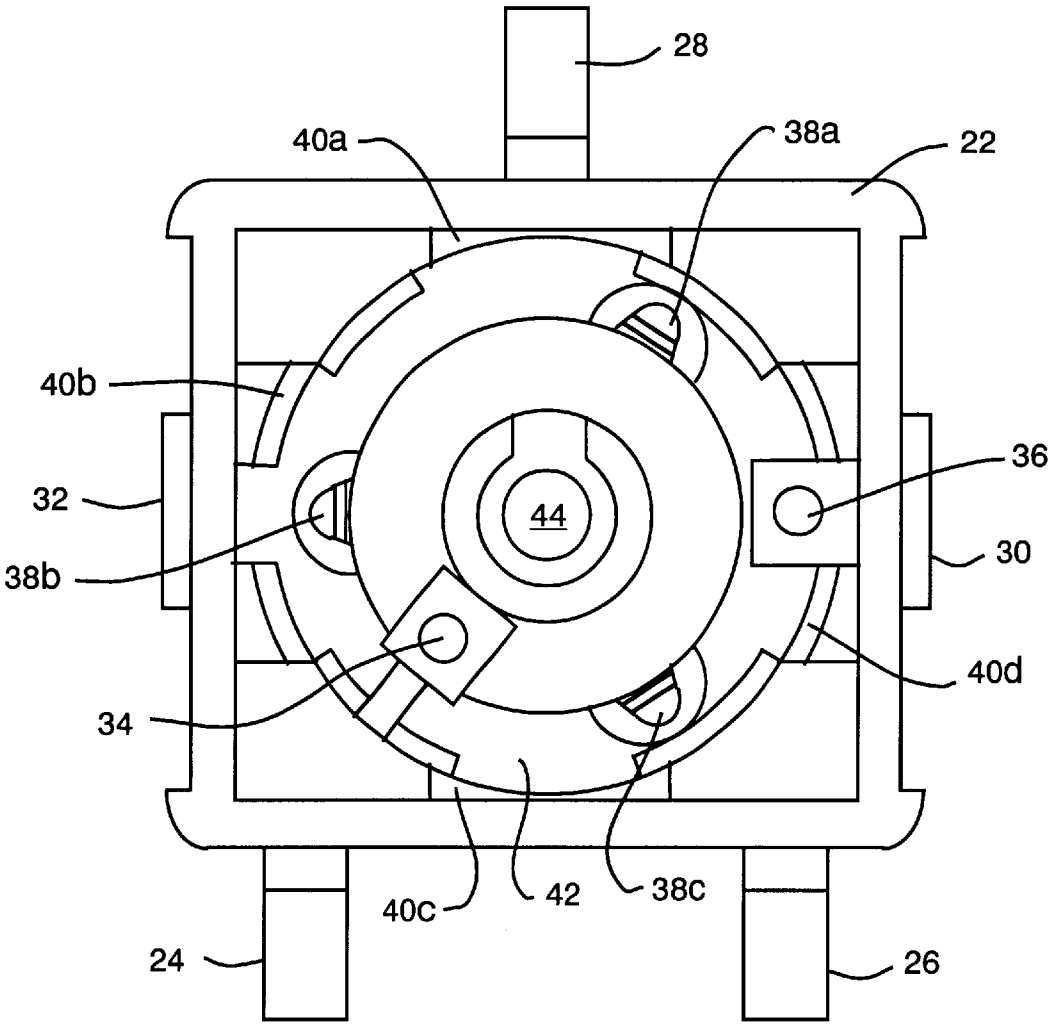
FIG. 4 is a plan view of the insulating housing.

Referring now to FIG. 4, a plan view of the insulating housing 12 is shown. The three stake posts 38*a*, 38*b*, 38*c* hold the metal dome 14. Side supports 40*a*, 40*b*, 40*c*, and 40*d* are provided for the elastomeric dome 16 which rests on surface 42 within the base. Center contact 44 makes electrical contact with the center of the metal dome 14 when the switch is in state 3. Inside terminal 34 is connected to outside terminal 24 and makes electrical contact with the metal dome 14. Inside terminal 36 is connected to outside terminal 26 and makes electrical contact with the conductive portion 17 of the elastomeric dome 16. The inside center terminal 44 is connected to outside terminal 28 and also makes electrical contact with the center of the metal dome 14 when the switch is in state 3.

Figure 5:
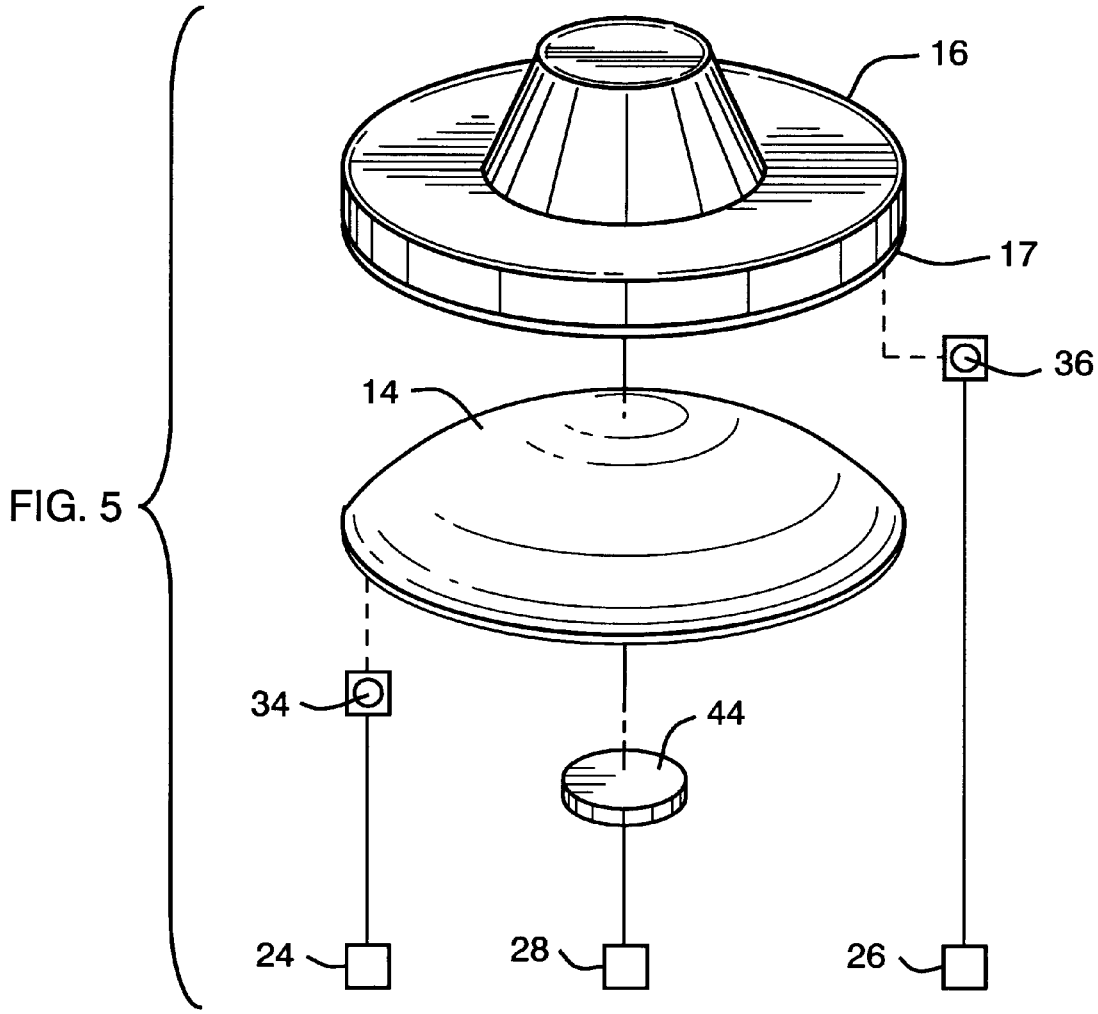
FIG. 5 is a simplified perspective view of the electrically conductive components of the three-state pushbutton switch of FIG. 1.

Referring now to FIG. 5, a simplified perspective view of the electrical conductive components of the three-state pushbutton is shown. When pressure is applied to the top of elastomeric dome 16, it collapses enabling the conductive bottom surface portion 17 to make electrical contact with the top of the metal dome 14. When additional pressure is applied the top of the elastomeric dome 16, the metal dome 14 collapses making electrical contact with the center contact 44 in the base of the housing 12.

The elastomeric dome 16 is embodied with a material such as silicone. The conductive material on the bottom of the elastomeric dome 16 is a conductive coating such as conductive silver silicone. The elastomeric portion is made by a well known injection molding process and the conductor coating is sprayed on the bottom.

The metal dome 14 is made from stainless steel (silver plated). The curvature is very slight. The metal dome 14 is a commercial item available from many sources. The center conductor 44 is made of brass with silver plating.

Referring now to FIG. 6, a compression curve provides a plot of Resistance versus Force as force is applied to activate the pushbutton switch 10. The first negative slope 60 indicates the collapse of the elastomeric dome 16 and the second negative slope 61 indicates the collapse of the metal dome as more force is applied to the switch pushbutton 20.

Figure 7:
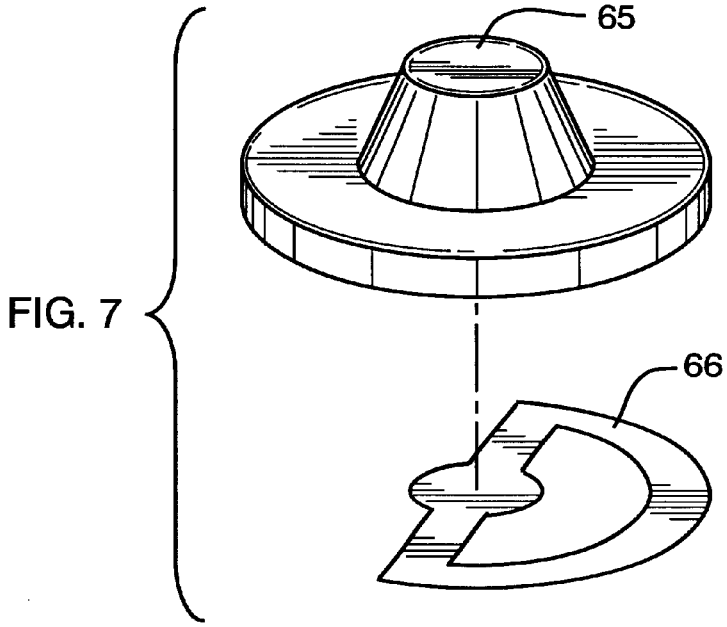
FIG. 7 shows an alternate embodiment of the conductor on the bottom of the upper dome of FIG. 2.

Referring to FIG. 7, an alternate embodiment of an elastomeric dome 65 is shown comprising a metallic conductor 66 positioned below the dome 65. The conductor 66 is made of beryllium copper (silver plated) and is semicircular in shape which satisfies the requirement to make contact with internal terminal 36 and dome 14. An advantage of using the metallic conductor is that the contact resistance can be lower than that achieved with a conductive elastomeric coating.

Figure 8:
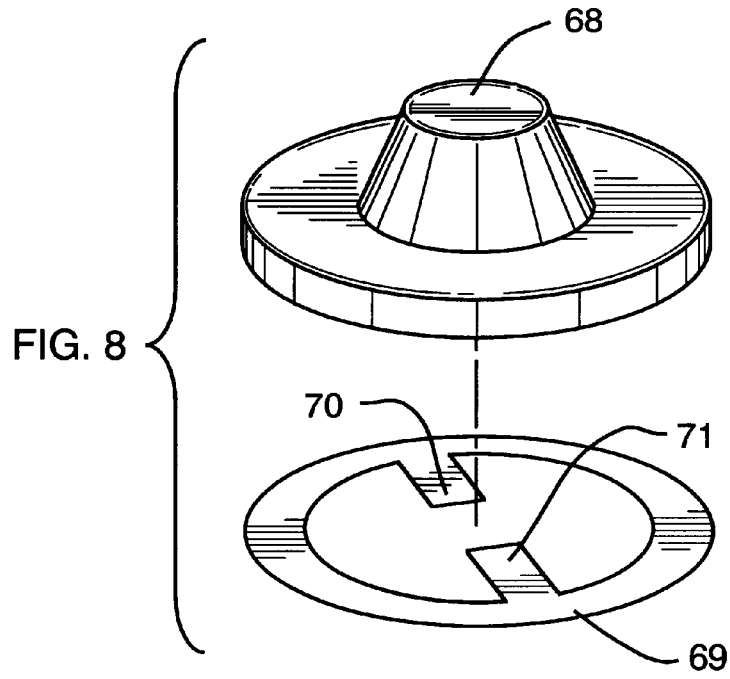
FIG. 8 shows a second alternate embodiment of the conductor on the bottom of the upper dome of FIG. 2.

Referring to FIG. 8, a second alternate embodiment of an elastomeric dome 68 is shown comprising a circular metallic conductor 69. Positioned below dome 68, the conductor 69 comprises two opposite inwardly extending radius tabs 70, 71 for making connection to dome 14. The circular portion makes contact with internal terminal 36. The conductor 69 is made of beryllium copper (silver plated).

Figure 9:
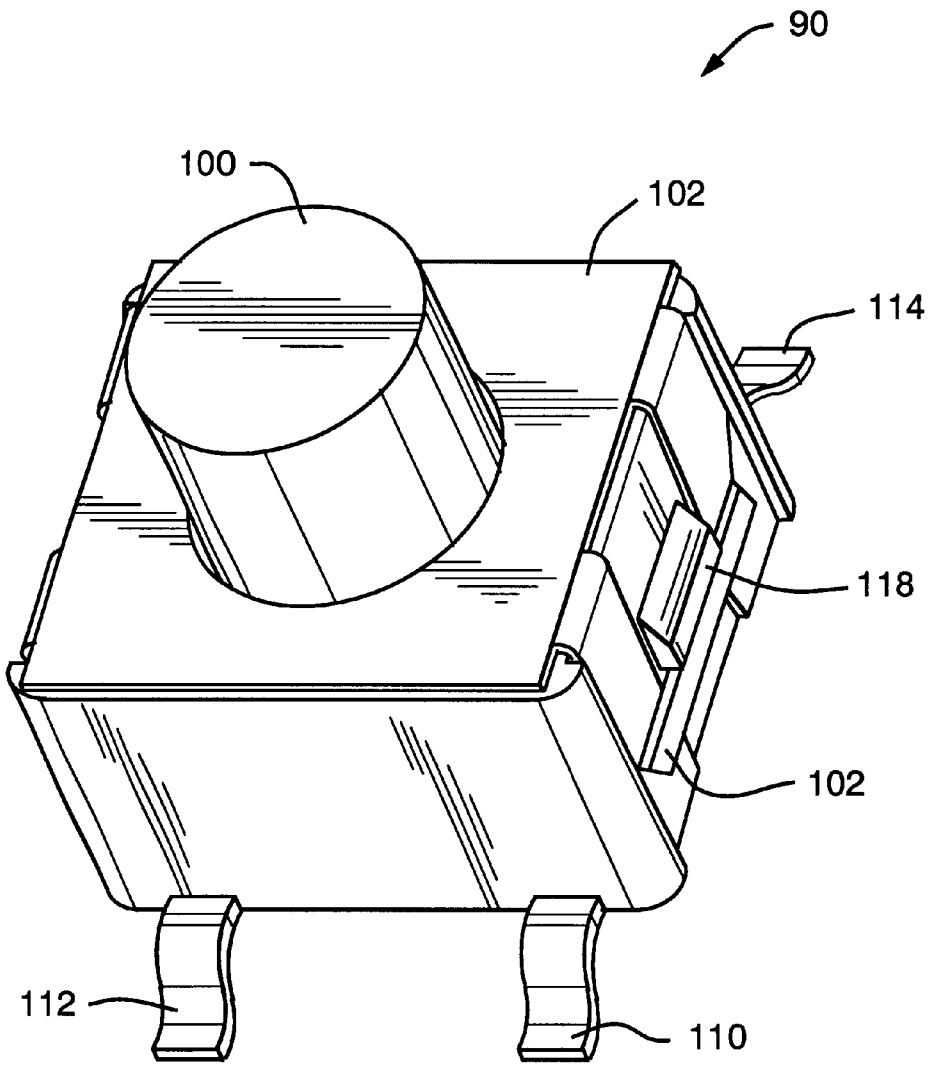
FIG. 9 is a perspective view of an alternate embodiment of the tactile feedback, three-state pushbutton switch.
Figure 10:
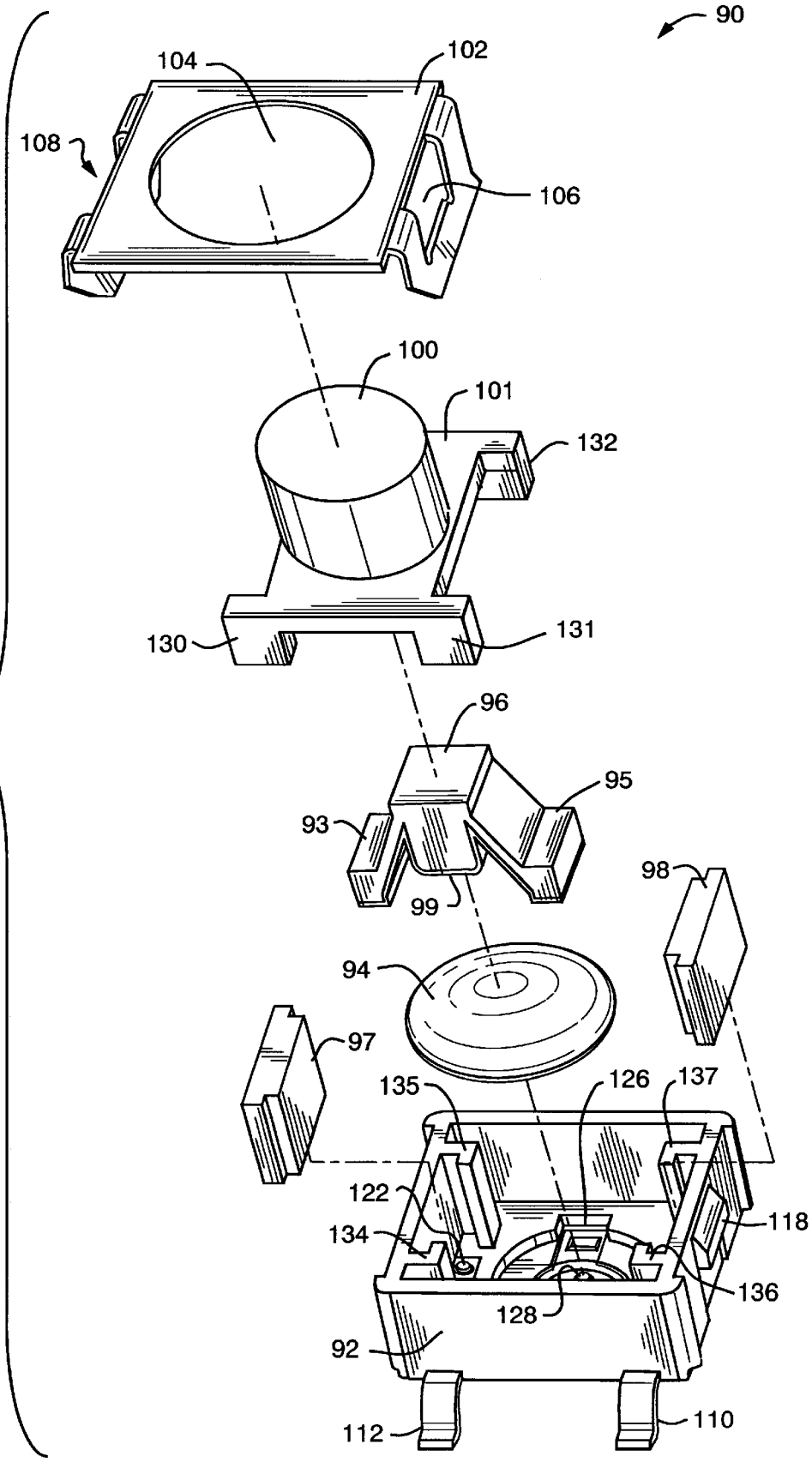
FIG. 10 is a fragmentary perspective view of the alternate embodiment, tactile feedback, three-state pushbutton switch of FIG. 9.

Referring now to FIG. 9 and FIG. 10, an alternate embodiment is shown of a tactile feedback, three-state pushbutton switch 90. FIG. 9 is a perspective view of the complete switch 90. FIG. 10 is a fragmentary perspective view of the alternate embodiment showing an elastomeric element 96 disposed above a metal dome 94. The pushbutton switch 90 comprises a base housing 92 having two terminals 110, 112 extending from one side and two terminals 114, 116 extending from an opposite side of the housing 92. A concave-shaped metal disc 94 rests on contacts 124, 126 on opposite sides of the inside bottom surface of housing 92.

A pushbutton 100 is positioned above the elastomeric element 96 and the upper portion of pushbutton 100 extends through an opening 104 in a frame 102 which secures the switch components within the switch 90. The pushbutton 100 activates the three-states of switch 90 when it is pushed inward toward the base. The pushbutton 100 comprises four legs 130–133, each of which slide between the corners of the base housing 92 and the sides of the retainer holders 134–137, when the pushbutton 100 is pushed inward. The legs 130–133 of the pushbutton 100 extend away from the horizontal portion 101 so that they can protrude into the inside corners of the housing 92 formed by the retainer holders 134–137. The frame 102 is secured to the housing 92 by tabs 118, 119 on opposite sides of the housing 92. Each of the tabs 118, 119 protrudes into openings 106, 108 respectively of frame 102. Retainers 97, 98 slide into spaces formed by retainer holders 134, 135 and retainer holders 136, 137 respectively. The bottom surfaces of retainer 97, 98 rest on the outer upper surfaces of outer feet 93, 95 of the elastomeric element 96.

Figure 11:
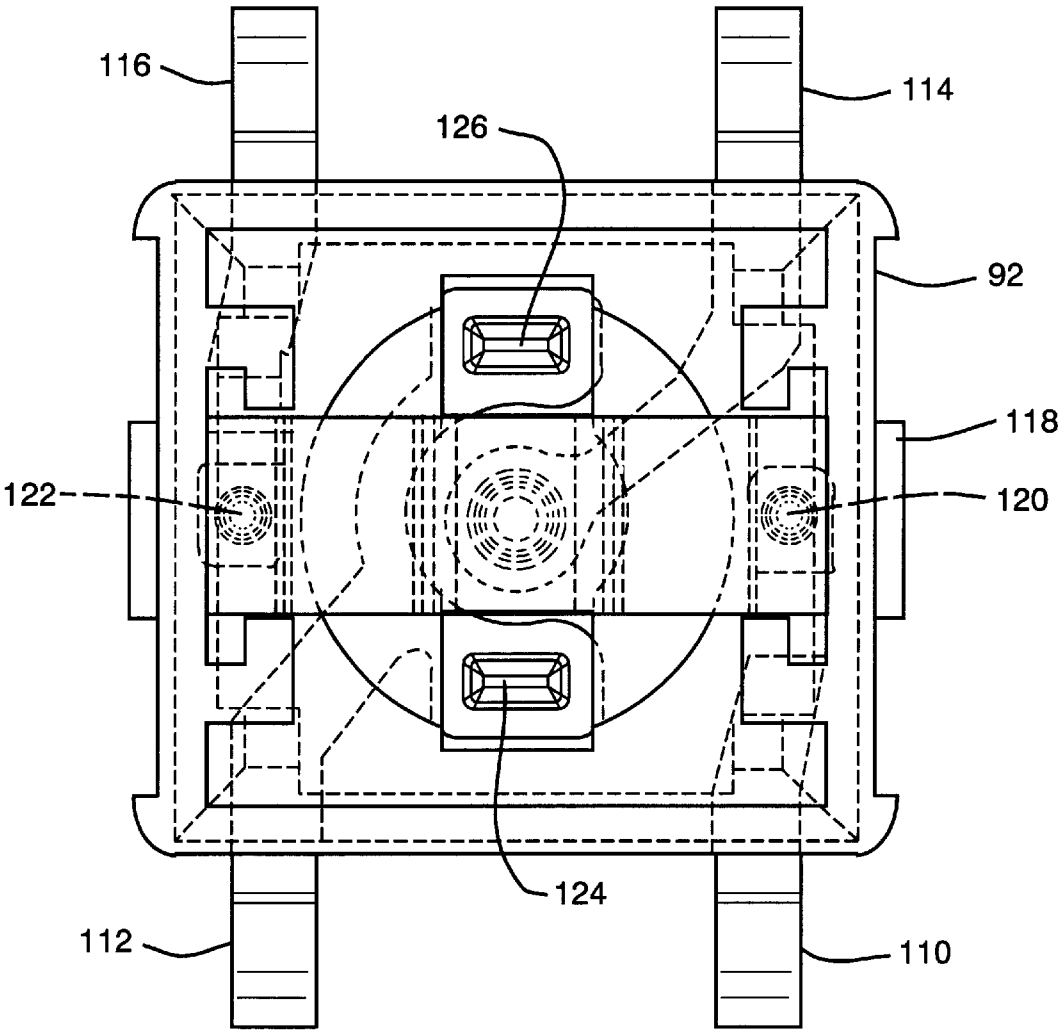
FIG. 11 is a plan view of the insulating housing of the alternate embodiment of FIG. 10.

Referring now to FIG. 11, a plan view of the housing 92 for the three-state switch 90 is shown. The switch housing 92 has two terminals 110, 116 that connect to the elastomeric dome 96 via contacts 120, 122 respectively. Center contact 128 makes contact with the center of the metal dome 94 when it is depressed and center contact 128 is connected to terminal 114. Contacts 124 and 126 on the inside base of the housing 92 make constant contact with the outer portion of the metal dome 94, and they both connect to terminal 112.

Figure 12:
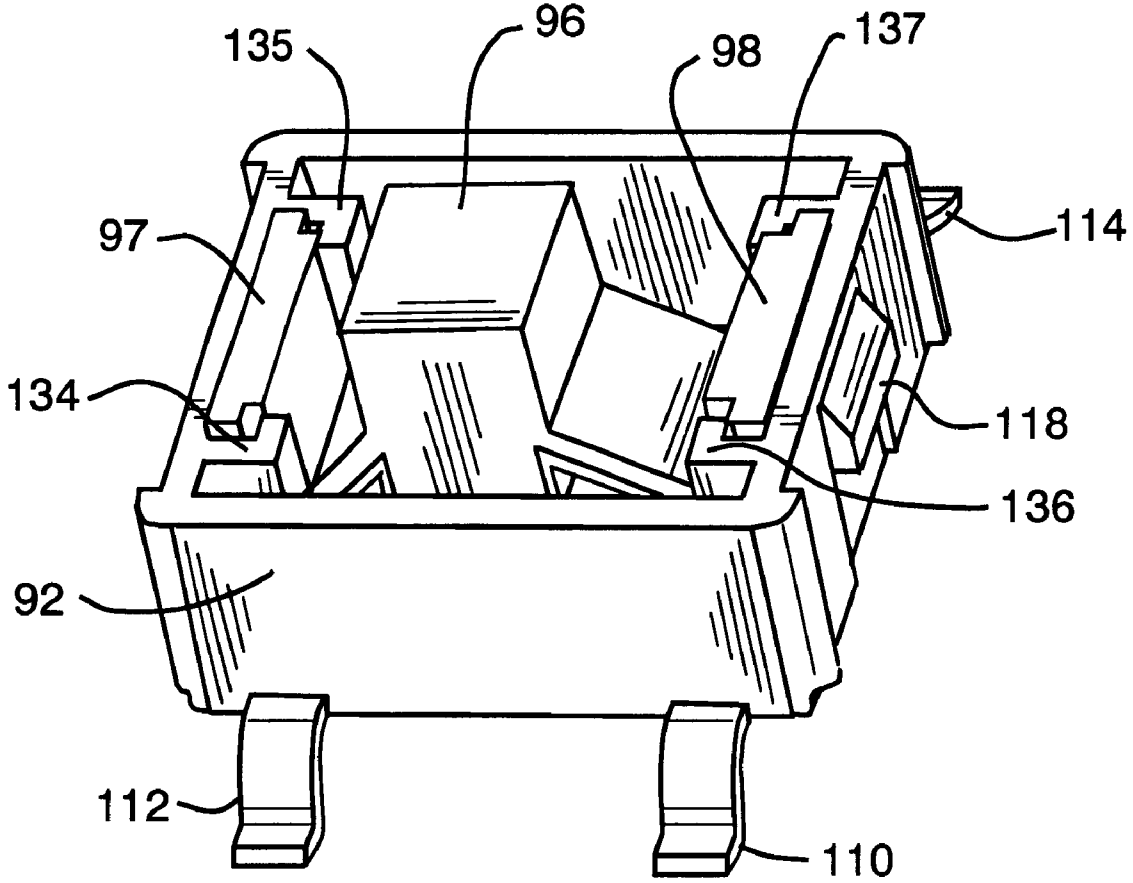
FIG. 12 is a perspective view of the alternate embodiment of FIG. 9 with the surface plate and pushbutton removed showing the extruded elastomeric element and retainers on each side of the elastomeric element.

Referring now to FIG. 12, a perspective view of the alternate embodiment is shown with the surface plate 102 and pushbutton 100 removed exposing the elastomeric element 96 and the retainers 97, 98. The retainers 97, 98 are shown positioned within housing brackets 134, 135 and brackets 136, 147 respectively. Such brackets are formed as part of the housing 92. The retainers 97, 98 rest on top of the outer feet 93, 95 of the elastomeric element 96.

Referring to FIGS. 10 and 12, the elastomeric element 96 comprises a material such as silicone with a conductive material 99 applied to the underside of all portions of the elastomeric element 96. The conductive material 99 portion is a conductive silicone with silver fill and the element 96 combination of the silicone and conductive material 99 may be produced by an extrusion process for low cost. The conductive material 99 may also be sprayed on the bottom of the elastomeric element. The angle of the sides 140, 141 relative to the vertical center section 142 is proportional to the force required to push the pushbutton 100 and activate the switch 90. The greater the angle the less force required to move the elastomeric element 96 downward to contact the metal dome 94.

Figure 13A:
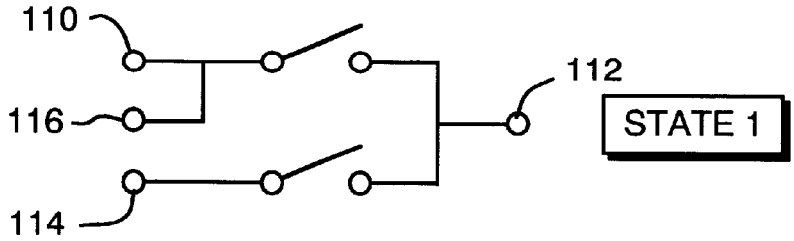
FIGS. 13A, 13B and 13C are electrical schematics of the three state switch of FIG. 11.
Figure 13B:
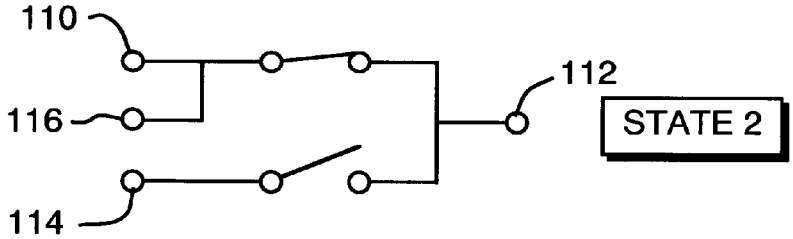
Figure 13C:
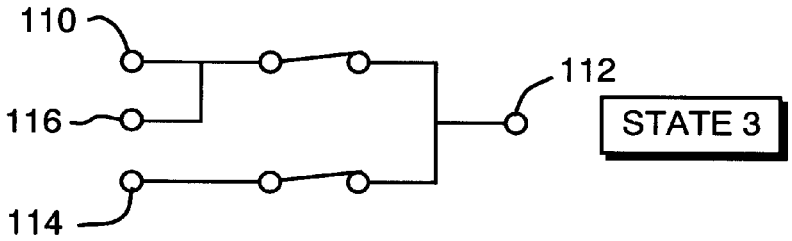

Referring to FIGS. 13A, 13B and 13C, electrical schematics of the three state switch pushbutton switch 90 of FIG. 11 are shown. FIG. 13A shows the switch contacts in the normally open position. FIG. 13B shows one of the contacts in a closed position whereby electrical signal on terminal 112 is transferred to terminals 110 and 116. FIG. 13C shows both of the contacts in a closed position whereby the electrical signal on terminal 112 is transformed to not only terminals 110 and 116 but also terminal 114.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. A tactile feedback pushbutton switch comprising:

an insulated housing having an inner bottom surface and a plurality of walls;

a conductive contact provided on approximately the center of said inner bottom surface of said housing;

an elastomeric dome disposed in said insulated housing having a conductive means attached to a bottom surface of said dome for making an electrical contact when said pushbutton is activated;

a switching element, disposed between said conductive contact and said conductive means of said elastomeric dome, having a first state of no electrical contact, having a second state of making electrical contact with said conductive means of said elastomeric dome, and having a third state of said conductive means electrically contacting said switching element which contacts said conductive contact, as a pushbutton is being pressed in a direction toward said bottom surface of said housing;

said pushbutton, disposed above said rubber dome, comprises a plurality of legs, for limiting the travel of said pushbutton within said housing;

a collar disposed around said elastomeric dome having an opening for a top portion of said dome to extend therethrough; and a frame having an opening for said pushbutton to extend therethrough, said frame comprises at least a pair of sides which snap over tabs on the outside of said housing.

2. The tactile pushbutton switch as recited in claim 1 wherein said switch comprises at least three external terminals for connecting said switch in a circuit.

3. The tactile pushbutton switch as recited in claim 1 wherein said conductive means on the bottom of said elastomeric dome comprises a conductive coating.

4. The tactile pushbutton switch as recited in claim 1 wherein said conductive means comprises a semicircular conductor positioned below said dome.

5. The tactile pushbutton switch as recited in claim 1 wherein said conductive means comprises a circular conductor with two opposite inwardly extending tabs positioned below said dome.

6. The tactile pushbutton switch as recited in claim 1 wherein said switching element comprises a metal dome.

7. A method of providing an extended travel tactile feedback pushbutton switch comprising the steps of:

providing an insulated housing having an inner bottom surface and a plurality of walls;

providing a conductive contact on approximately the center of said inner bottom surface of said housing;

disposing an elastomeric dome in said insulated housing having a conductive means attached to a bottom surface of said dome for making an electrical contact when a pushbutton is activated;

disposing a switching element between said conductive contact and said elastomeric dome conductive means which provides a first switch state of no contact;

pressing said pushbutton a first distance in a direction toward said bottom surface of said housing wherein said conductive means of said elastomeric dome makes electrical contact with said switching element which provides a second switch state;

pressing said pushbutton a second distance in the direction of said bottom surface of said housing wherein said conductive means of said elastomeric dome electrically contacts said switching element which contacts said conductive contact, thereby providing a third switch state;

providing said pushbutton having a plurality of legs disposed above said elastomeric dome;

disposing a collar around said elastomeric dome, said collar having an opening for a top portion of said dome to extend therethrough; and extending said pushbutton through an opening in a frame, said frame having a pair of sides, each side having an opening which snaps over a tab on the outside of said housing.

8. The method as recited in claim 7 wherein said method comprises the step of providing a plurality of external terminals extending from said housing for connecting said switch in a circuit.

9. The method as recited in claim 7 wherein said step of providing said conductive means on the bottom of said elastomeric dome comprises the step of providing a silver silicone conductive coating on said bottom.

10. The method as recited in claim 7 wherein said step of providing said conductive means on the bottom of said elastomeric dome comprises the step of providing a semicircular conductor positioned below said dome.

11. The method as recited in claim 7 wherein said step of providing said conductive means on the bottom surface of said elastomeric dome comprises the step of providing a circular conductor with two opposite inwardly extending tabs positioned below said dome.

12. The method as recited in claim 7 wherein said step of providing said switching element comprises the step of providing a metal dome including silver plated stainless steel.

13. A tactile pushbutton switch comprising:

an insulated housing having an inner bottom surface and a plurality of walls;

a pair of opposite walls of said housing, each of said walls having a pair of integral right angle appendages extending inward and disposed a predetermined distance from each other;

a first conductive contact disposed on approximately the center of said inner bottom surface of said housing;

a first switch element having an upper elastomeric portion and a lower portion comprising conductive means for making an electrical contact when said pushbutton is activated;

second conductive contacts on said bottom surface of said housing, each disposed between said right angle appendages for making electrical contact with said lower portion of said first switch element on two opposite sides of said switch;

a second switch element, disposed between said first conductive contact on said inner bottom surface of said housing and said conductive means of said first switch element, having a first state of no contact with said first switch element, having a second state of making electrical contact with said conductive means of said first switch element, and having a third state of said conductive means of said first switch element electrically contacting said second switch element which electrically contacts said first conductive contact, as a pushbutton of said switch is being pressed in a direction toward said bottom surface of said housing;

said pushbutton, disposed above said elastomeric element, comprises a plurality of legs for limiting the travel of said pushbutton within said housing;

retainer means, inserted between each of said right angle appendages on said opposite sides of said switch resting on top of the outer feet of said first switch element, for forcing said lower portion of said first switch element to make electrical contact with said second conductive contacts; and a frame having an opening for said pushbutton to extend therethrough, said frame having a pair of sides which secure said frame to said housing.

14. The tactile pushbutton switch as recited in claim 13 wherein said switch comprises a plurality of external terminals for connecting said switch in a circuit.

15. The tactile pushbutton switch as recited in claim 13 wherein said conductive means on the bottom of said elastomeric dome comprises a conductive coating including conductive silicone having a silver fill.

16. The tactile pushbutton switch as recited in claim 13 wherein said second switch element comprises a metal dome.

17. A method of providing an extended travel tactile feedback pushbutton switch comprises the steps of:

providing an insulated housing have an inner bottom surface and a plurality of walls;

providing right angle appendages extending inward from a pair of opposite walls of said housing, said right angle appendages being disposed a predetermined distance from each other on each of said pair of opposite walls;

disposing a first conductive contact on approximately the center of said inner bottom surface of said housing;

providing a first switch element having an upper elastomeric portion and a lower portion comprising conductive means for making an electrical contact when said pushbutton is activated; and placing a pair of second conductive contacts on said bottom surface of said housing, each located between said right angle appendages for making electrical contact with said lower portion of said first switch element on two opposite sides of said switch;

positioning a second switch element between said first conductive contact on said inner bottom surface of said housing and said conductive means of said first switch element having a first state of no contact with said first switch element, having a second state of contacting said conductive means of said first switch element, and having a third state of electrically contacting said conductive means of said first switch element and contacting said first conductive contact, as a pushbutton of said switch is being pressed in a direction toward said bottom surface of said housing, said pushbutton being positioned above said first switch element;

inserting retainers between each of said right angle appendages on said opposite sides of said switch wherein said retainers rest on top of the outer feet of said first switch element, thereby forming said lower portion of said first switch element to make electrical contact with said second conductive contacts; and extending said pushbutton through an opening in a frame, said frame having a pair of sides which secure said frame to said housing.

18. The method as recited in claim 17 wherein said step of providing said pushbutton switch comprises the step of providing a plurality of external terminals for connecting said switch into a circuit.

19. The method as recited in claim 17 wherein said step of providing a first switch element comprises the step of providing said lower portion with said conductive means having a conductive silicone with a silver fill.

20. The method as recited in claim 17 wherein said step of positioning a second switch element comprises the step of providing a metal dome for said second switch element.

* * * * *